US007971818B2

(12) United States Patent
Smidt et al.

(10) Patent No.: US 7,971,818 B2
(45) Date of Patent: Jul. 5, 2011

(54) APPARATUS AND METHOD FOR SUPPORTING A REMOVABLE ANVIL

(75) Inventors: Brian Smidt, Otley, IA (US); Darin Dux, Pella, IA (US); Scott Eberts, Pella, IA (US); Duane Harthoorn, Lynnville, IA (US)

(73) Assignee: Vermeer Manufacturing Company, Pella, IA (US)

( * ) Notice: Subject to any disclaimer, the term of this patent is extended or adjusted under 35 U.S.C. 154(b) by 387 days.

(21) Appl. No.: 12/079,420

(22) Filed: Mar. 26, 2008

(65) Prior Publication Data

US 2009/0242677 A1 Oct. 1, 2009

(51) Int. Cl.
*B02C 13/00* (2006.01)
*B02C 23/02* (2006.01)

(52) U.S. Cl. ..... 241/186.35; 241/32; 241/189.1

(58) Field of Classification Search ..... 241/189.1, 241/186.35, 32
See application file for complete search history.

(56) References Cited

U.S. PATENT DOCUMENTS

| | | | | |
|---|---|---|---|---|
| 2,209,277 | A | 7/1940 | Mankoff | |
| 3,170,643 | A * | 2/1965 | Hanse et al. | 241/189.1 |
| 3,823,878 | A * | 7/1974 | Ishikura | 241/69 |
| 4,119,277 | A | 10/1978 | Snyder et al. | |
| 4,146,184 | A | 3/1979 | Whitney | |
| 4,504,019 | A | 3/1985 | Newell et al. | |
| 4,650,129 | A | 3/1987 | Newell et al. | |
| 4,730,791 | A | 3/1988 | Haulser et al. | |
| 5,713,525 | A | 2/1998 | Morey | |
| 5,795,443 | A | 8/1998 | Greve | |
| 5,881,959 | A | 3/1999 | Hadjinian et al. | |
| 5,911,372 | A * | 6/1999 | Williams, Jr. | 241/32 |
| 5,947,395 | A * | 9/1999 | Peterson et al. | 241/32 |
| 5,975,443 | A * | 11/1999 | Hundt et al. | 241/27 |
| 6,422,495 | B1 | 7/2002 | De Boef et al. | |
| 6,474,579 | B1 | 11/2002 | Bardos et al. | |
| 6,641,065 | B2 | 11/2003 | Bardos et al. | |
| 6,786,439 | B2 | 9/2004 | Zehr | |
| 6,843,435 | B2 * | 1/2005 | Verhoef et al. | 241/73 |
| 6,978,955 | B2 | 12/2005 | Verhoef et al. | |
| 2003/0141394 | A1 | 7/2003 | Ueda et al. | |
| 2005/0184178 | A1 | 8/2005 | Smidt et al. | |

FOREIGN PATENT DOCUMENTS

WO WO 03/015925 A1 2/2003

OTHER PUBLICATIONS

Horizontal Grinder HG365/HG525, PN 605508-001-1; Date: publicly known prior to the filing date of the present application; 8 pgs.

* cited by examiner

*Primary Examiner* — Bena Miller
(74) *Attorney, Agent, or Firm* — Merchant & Gould P.C.

(57) ABSTRACT

A grinding machine having an improved anvil mounting arrangement is provided. The mounting arrangement according to the present disclosure is configured to securely support an end of the feed table and an anvil, and also enables easy replacement of the anvil.

20 Claims, 14 Drawing Sheets

APPARATUS AND METHOD FOR SUPPORTING A REMOVABLE ANVIL

TECHNICAL FIELD

This disclosure generally relates to horizontal grind machines and, more particularly, to an anvil and anvil support arrangement and apparatus.

BACKGROUND

Grinding machines are used for a wide variety of purposes. Some common uses for grinding machines include grinding waste materials to increase the rate at which waste material decomposes, grinding wood materials to form mulch for landscaping, grinding asphalt for recycling, and grinding shingles for use in asphalt production. Grinding machines are used for many other purposes as well.

One type of grinding machine is known as a horizontal grinder. Horizontal grinders typically include a feed table for moving material towards a feed roller that forces the material into contact with a grinding drum. Horizontal grinders are described in greater detail in US 2005/0184178, which is incorporated in its entirety herein by reference. The present disclosure relates to an anvil and anvil support arrangement for a horizontal grinder.

SUMMARY

The present disclosure provides an apparatus and method for supporting a anvil within a grinder. The method and apparatus enable the anvil to be easily secured to the grinder and easily replaced when worn. A variety of examples of desirable product features or methods is set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
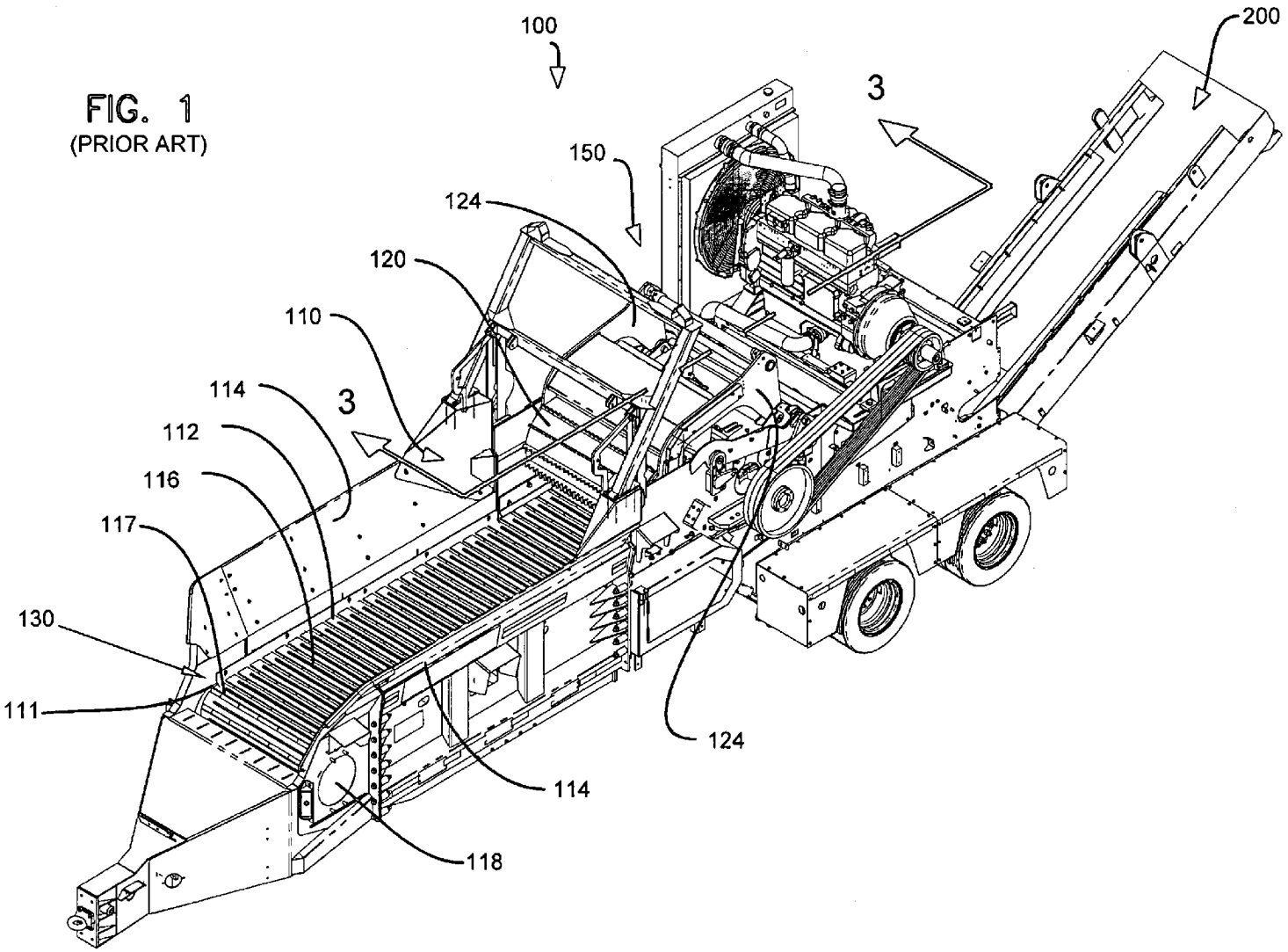
FIG. 1 (PRIOR ART)
FIG. 1 is a perspective view of the left side of a prior art materials grinder.

Referring to the drawings, and in particular to FIG. 1, a prior art materials grinder 100 is illustrated. This materials grinder 100 is a horizontal grinder and includes a mill box 150 and a feed hopper 110 to transport material to the mill box 150. The present disclosure relates to an improved anvil arrangement that can be incorporated into the depicted prior art material grinder 100, which can be used in a wide variety of grinding applications. The material grinder 100, for example, may be used to grind material such as leaves, shingles, and small branches, and is also capable of grinding larger objects such as large branches, boards, planks.

Figure 2:
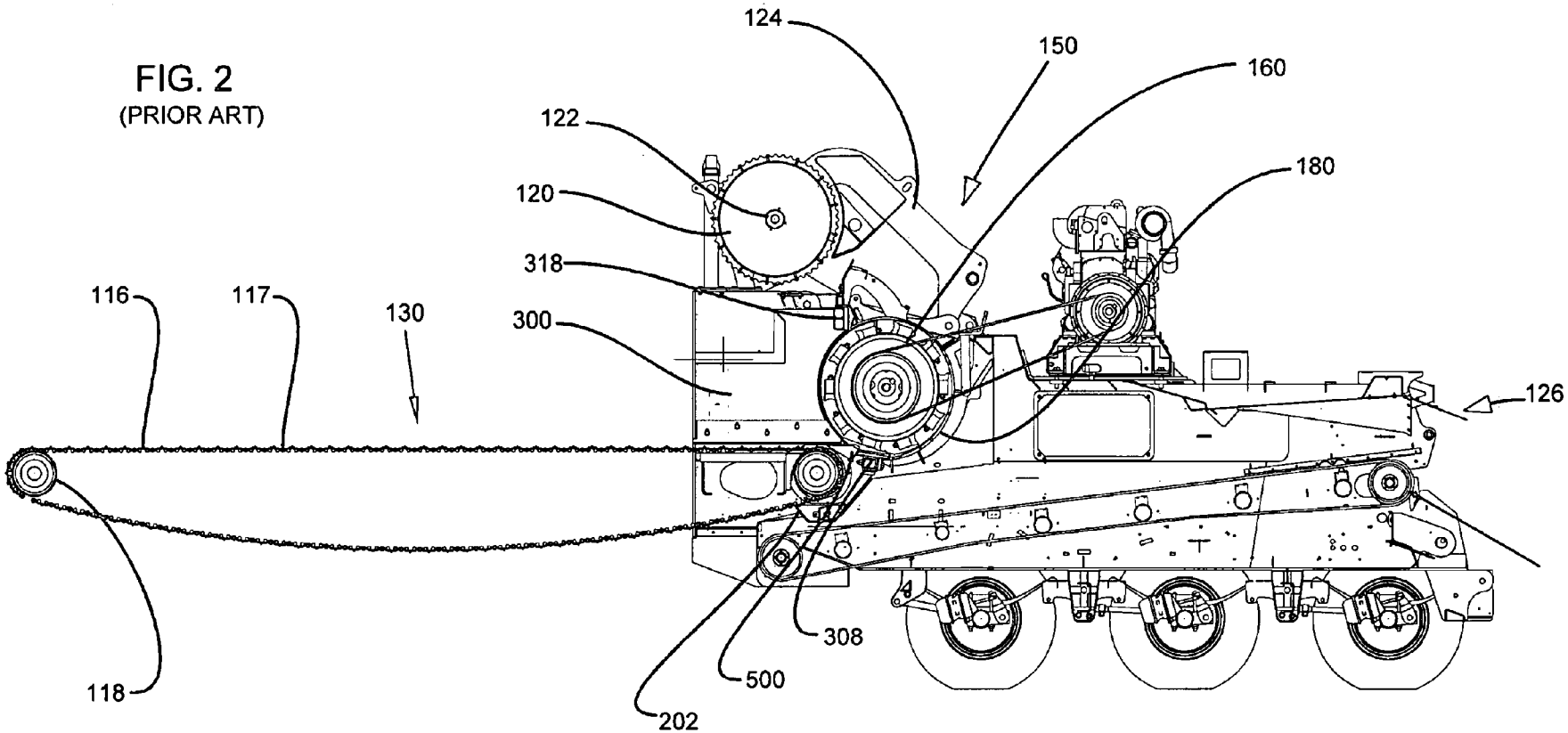
FIG. 2 (PRIOR ART)
FIG. 2 is a partial left-side view of the prior art materials grinder shown in FIG. 1.
Figure 4:
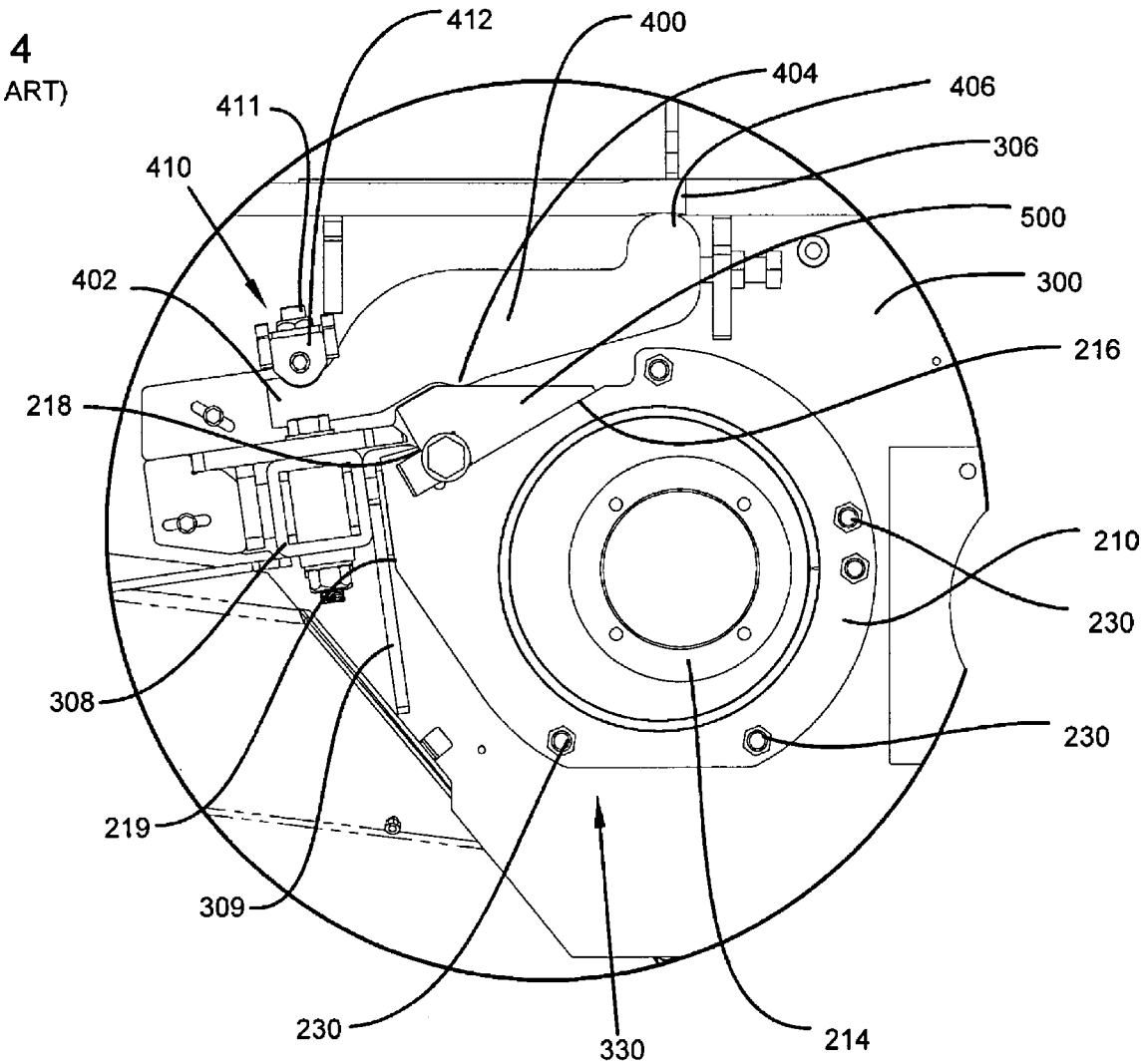
FIG. 4 (PRIOR ART)
FIG. 4 is a partial right-side view of the prior art materials grinder shown in FIG. 1.

Referring to FIGS. 1 and 2, the depicted material grinder 100 includes a feed hopper 110 having a feed table 112 and opposed sides 114. The feed table 112 defines a transport plane or bottom 111 of the feed hopper 110 onto which material is loaded for transport to the mill box 150. The feed table 112 includes a first conveyor roller 118, a second conveyor roller 202, and a conveyor arrangement 130. The conveyor arrangement 130 includes conveyor bars 116 that are attached to a conveyor chain 117. The conveyor chain 117 is routed around the first conveyor roller 118. The second conveyor roller 202 is powered, typically by a hydraulic motor, in a manner that allows the conveyor chain 117 and the conveyor bars 116 to be propelled in either direction. The first conveyor roller 118 is supported by the sides 114 of the feed hopper 110. The second conveyor roller 202 is mounted to sides 300 of the mill box 150. Cross-members 308, 318 extend between the sides 300 of the mill box 150. The cross-members 308, 318 provide the structure necessary to support the basic elements of the materials grinder 100, including a grinding drum 160, the second conveyor roller 202, an anvil 500, screens 180, and a feed roller 120. The first cross-member 308 is attached to each of the mill box sides 300 by a gusset 309 (FIG. 4). The material grinder 100 includes a feed roller 120 mounted on a feed roller shaft 122. The feed roller shaft 122 is supported on mount arms 124. During operation, material is propelled or conveyed towards a grinding drum 160 by the conveyor arrangement 130. As the material is conveyed, the feed roller 120 (driven by a hydraulic motor) engages the material to provide additional feed pressure to urge the material towards the grinding drum 160.

Figure 3:
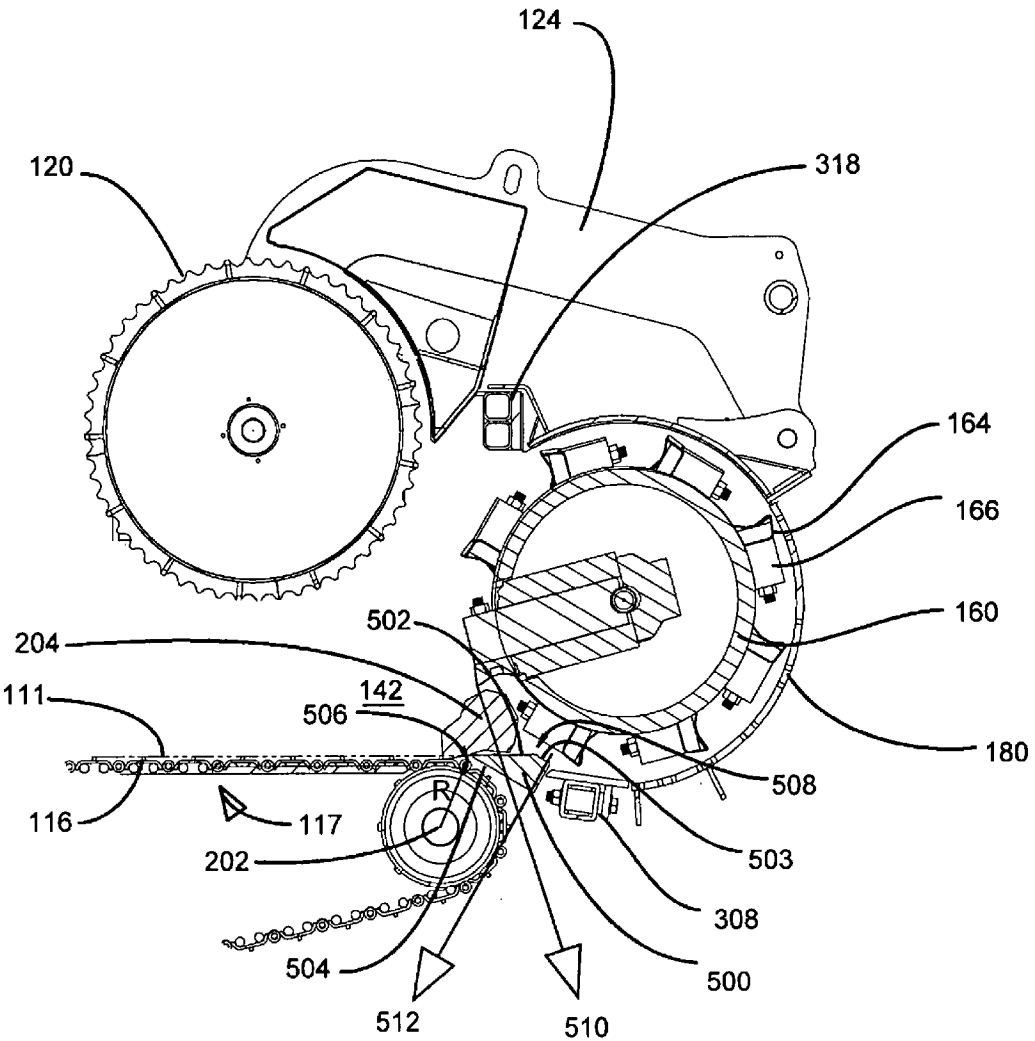
FIG. 3 (PRIOR ART)
FIG. 3 is a partial cross-section of the prior art materials grinder of FIG. 1, taken along line 3-3 of FIG. 1.

Referring now to FIG. 3, the grinding drum 160, the conveyor roller 202, and an anvil 500 of the prior art grinder 100 are described in greater detail. The grinding drum 160 is similar to that disclosed in U.S. Pat. No. 6,422,495, herein incorporated by reference in its entirety. The grinding drum 160 includes cutters 164 mounted on hammers 166. As the material approaches the grinding drum 160, the material is contacted by cutters 164 and forced into contact with the anvil 500. The anvil 500 is a wedge-shaped anvil having first and second surfaces 502, 504. The first and second surfaces 502, 504 define a wedge portion of the anvil 500. The material is fractured or broken upon impact with the cutters 164, or by a crushing or shearing force acting generally perpendicular to the first surface 502 of the anvil 500 (the shearing force being directionally represented by force vector 510 of FIG. 3). Some material may be sized such that it wedges between the anvil 500 and the cutters 164 and hammers 166, thereby generating a reaction force acting generally perpendicular to a third surface 503 of the anvil 500 (the reaction force being directionally represented by force vector 512). The material that passes by the anvil 500 will be further ground to a size necessary to pass through the screens 180. Once through the screens 180, the material will exit the mill box 150 and fall onto a discharge conveyor 126 (FIG. 2) for transport to a secondary conveyor 200 (FIG. 1) where it may be further transferred to any desired position (such as to a pile beside the materials grinder 100).

Still referring to FIG. 3, the primary grinding action of the materials grinder 100 involves the interaction of the cutters 164, which are traveling at a high rate of speed, with the stationary anvil 500. In particular, typical material, as represented by material 204, will be impacted by cutters 164 and driven down towards the anvil 500 and conveyor roller 202. The anvil 500 is placed in close proximity to the grinding drum 160 so that any ungrindable material, not able to pass by the anvil 500, will be retained at the infeed area 142, in order to prevent damage to other components including the screen 180. Upon contact with the grinding drum 160, the ungrindable materials will be forced backward, away from grinding drum 160, or will become trapped between cutters 164 and anvil 500. If the ungrindable material becomes trapped and stops the grinding drum 160, the resulting rapid deceleration will generate significant and unusual overload forces acting against the anvil 500, the roller 202, or a combination of both. The anvil 500, the roller 202, and the supporting framework may thus be subjected to severe loads. Preferably, the anvil is replaceable and the mounting arrangement configured such that the anvil is easily accessible for replacement and maintenance purposes.

Referring still to FIG. 3, the anvil 500 is also oriented such that the second surface 504 cooperates with the conveyor chain 117. For example, as material progresses toward the anvil 500, the material reaches a first nip point 506. The first nip point 506 is where the material transfers from the conveyor chain 117 to the anvil 500. At the first nip point 506, the second surface 504 is closest to the second conveyor roller 202 and the transport plane 111 of the feed table 112 to assist in lifting material off the conveyor chain 117 and reduce the amount of material carried around the second conveyor roller 202. Any material carried around the second conveyor roller 202 will drop out of the feed hopper 110 without being ground. The clearance between the conveyor chain 117 and the second surface 504 of the anvil 500 is minimized at the first nip point 506. In the depicted prior art embodiment, the second surface 504 is a generally flat surface that lies perpendicular to a radial line R projecting from the center of roller 202 toward the first nip point 506. This orientation reduces the chance of material wedging between the second conveyor roller 202 and the second surface 504 of the anvil 500. The orientation of the first surface 502 of the anvil 500 affects the performance of the grinder; for instance, if the first surface 502 is arranged higher than the feed table 112, or if the first surface is angled upward such that nip point 508 is higher than nip point 506, as compared to the bottom plane 111 of the feed table, the feeding characteristics will be negatively affected. Thus, the first surface 502 of the anvil 500 is generally aligned with the bottom plane 111 of the feed table. That is, the first surface 502 of the anvil 500 is oriented generally parallel to the bottom plane 111 of the feed table such that nip point 508 is aligned with nip point 506. In an alternative embodiment, the first surface 502 may be oriented to angle downward such that nip point 508 is lower than nip point 506.

Figure 5:
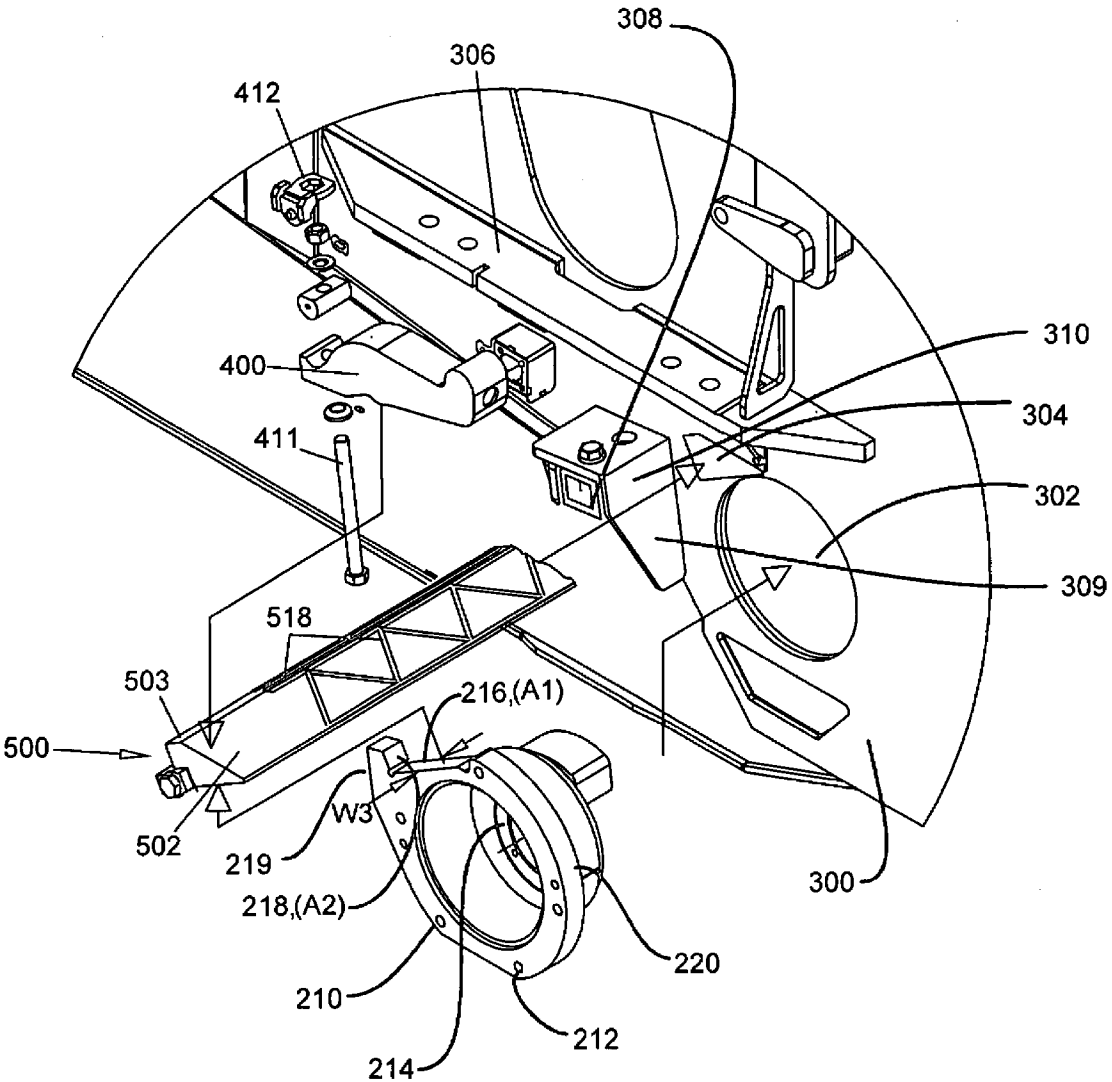
FIG. 5 (PRIOR ART)
FIG. 5 is a partially exploded perspective view of the right side of the prior art materials grinder of FIG. 1, showing an anvil, a mount, and a clamp arm.
Figure 6:
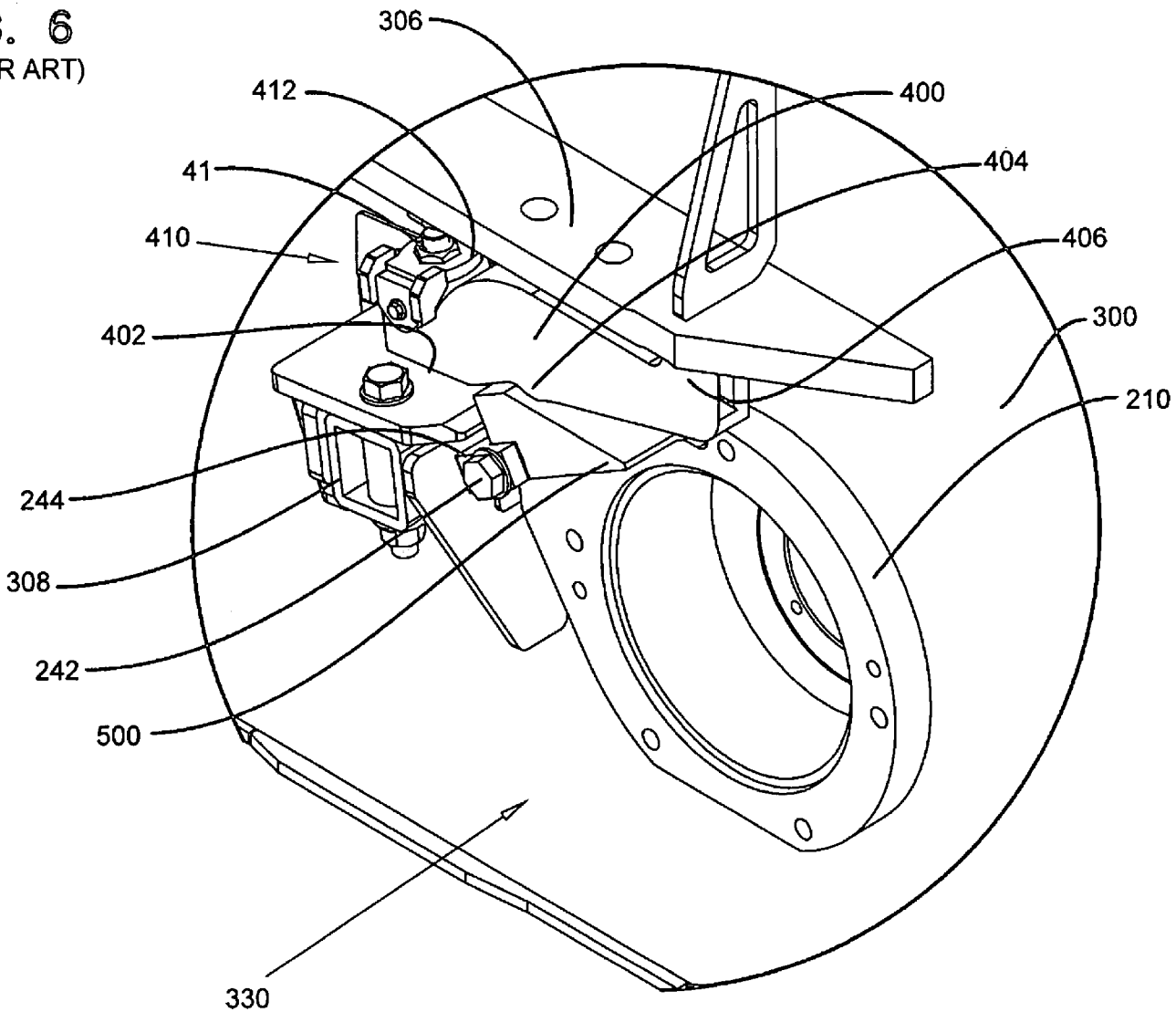
FIG. 6 (PRIOR ART)
FIG. 6 is a partial perspective view of the right side of the prior art materials grinder of FIG. 1, showing the anvil, the mount, and the clamp arm in installed positions.
Figure 7:
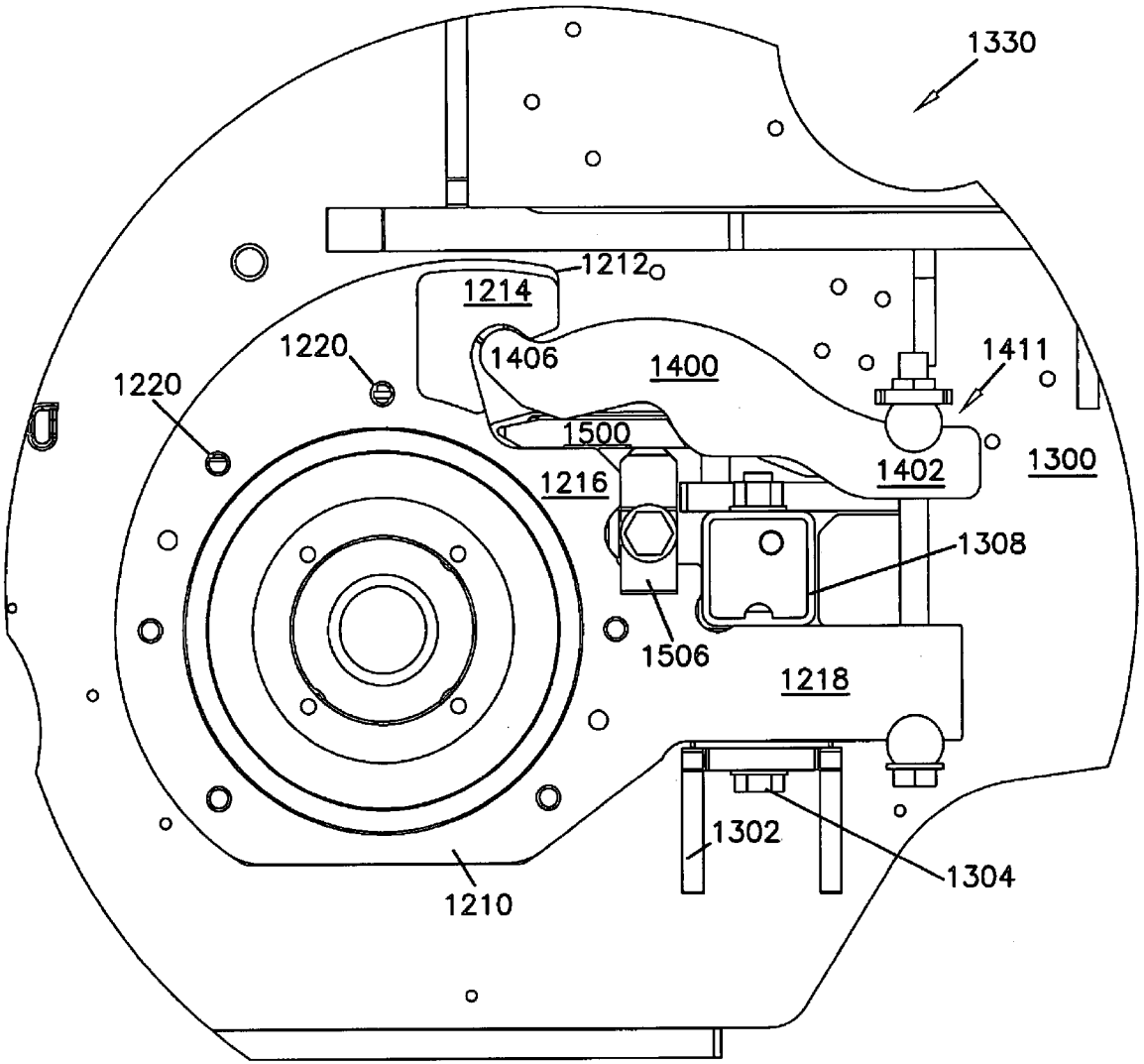
FIG. 7 is a partial right-side view of a first embodiment of a material grinder according to the present disclosure.
Figure 8:
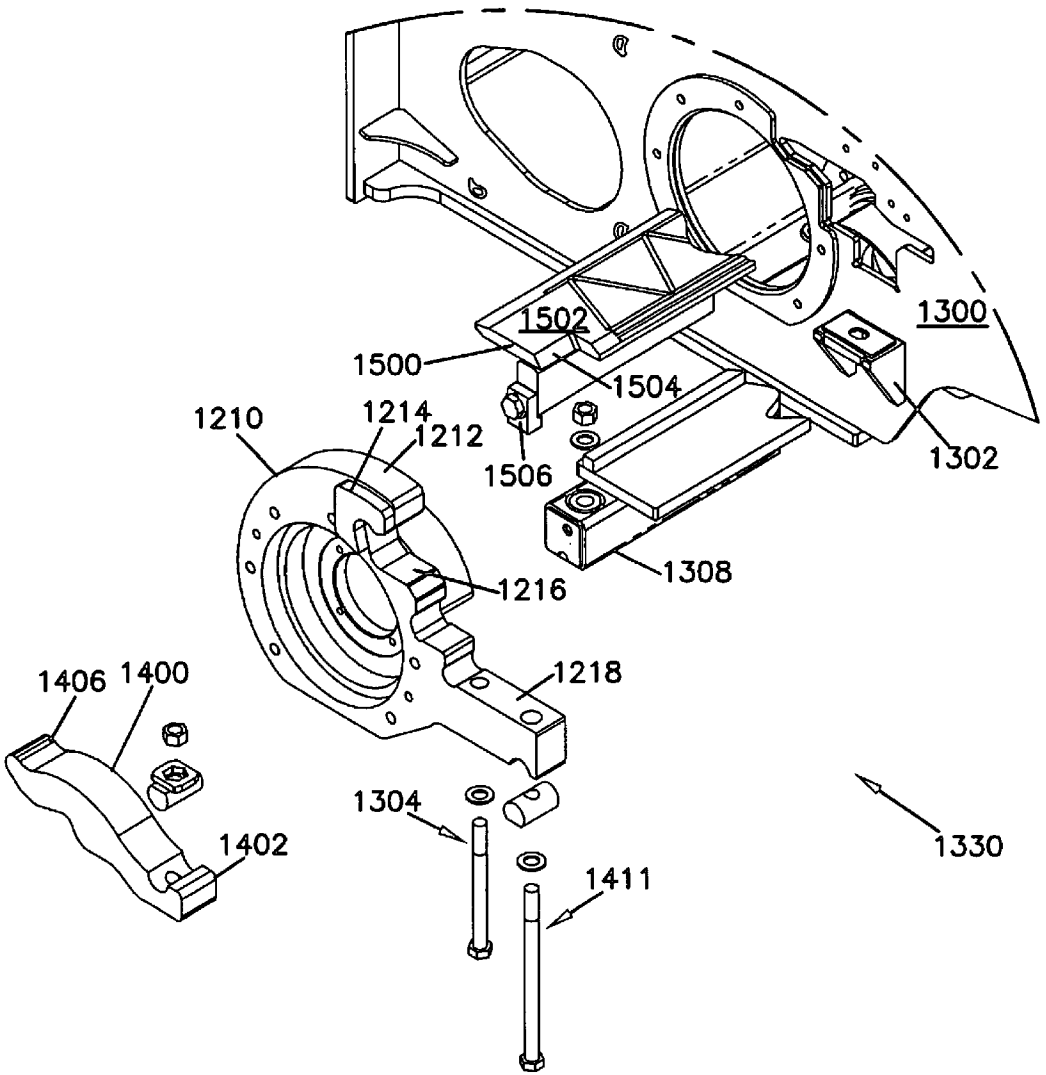
FIG. 8 is a partially exploded perspective view of the right side of the material grinder of FIG. 7, showing an anvil, a mount, and a clamp arm of the present invention.
Figure 9:
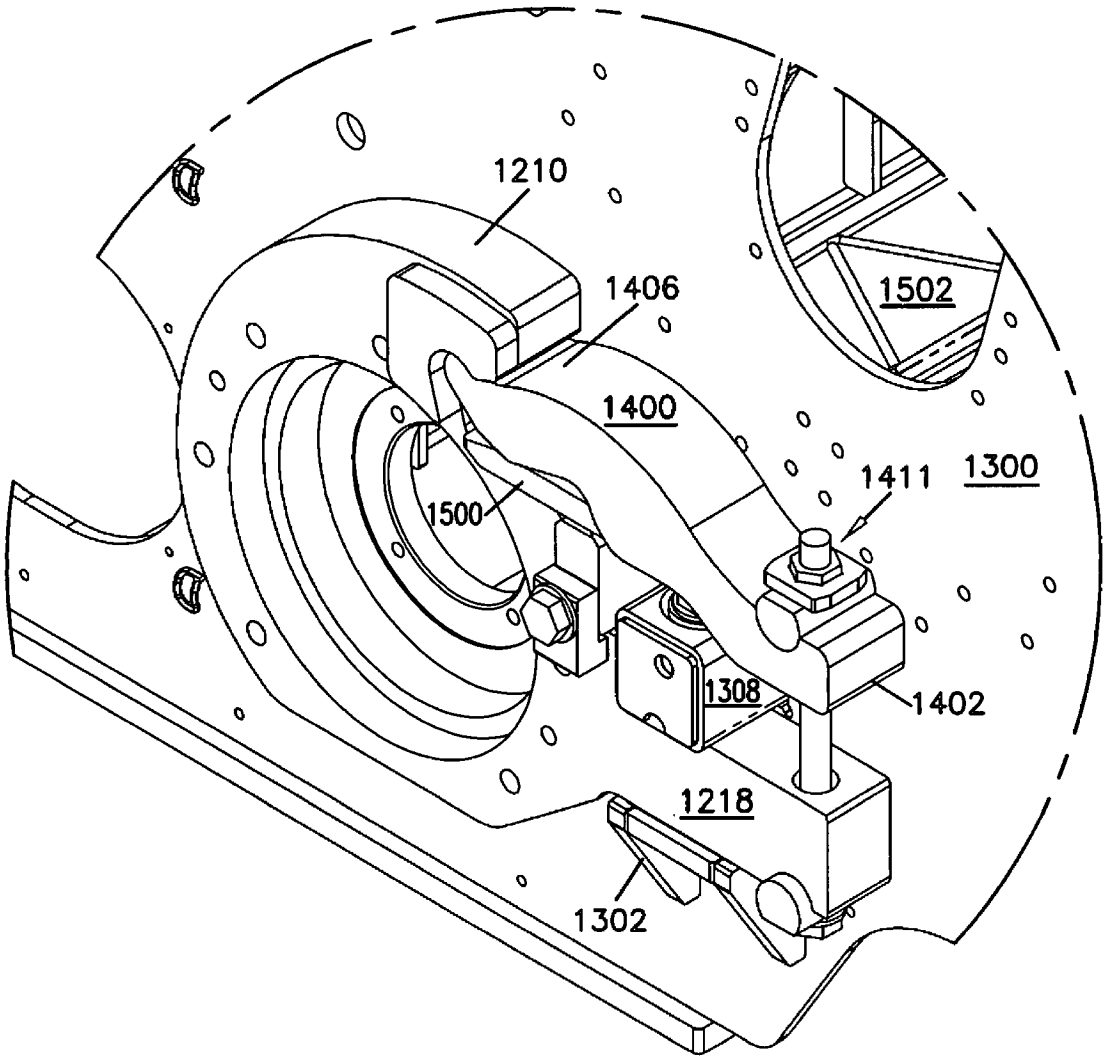
FIG. 9 is a partial perspective view of the right side of the material grinder of FIG. 7, showing the anvil, the mount, and the clamp arm in installed positions.
Figure 10:
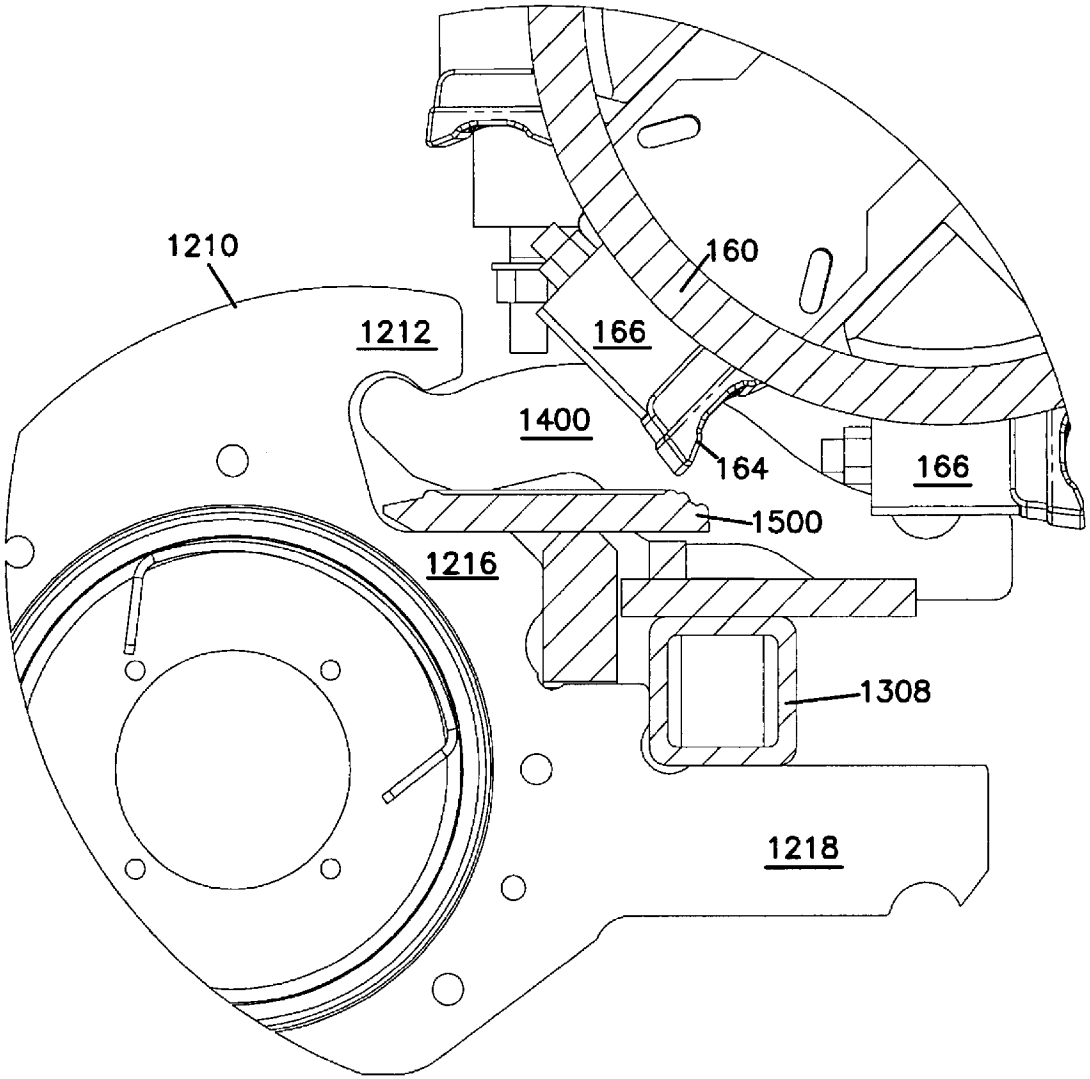
FIG. 10 is a cross-sectional view of a portion of the material grinder of FIG. 7.
Figure 11:
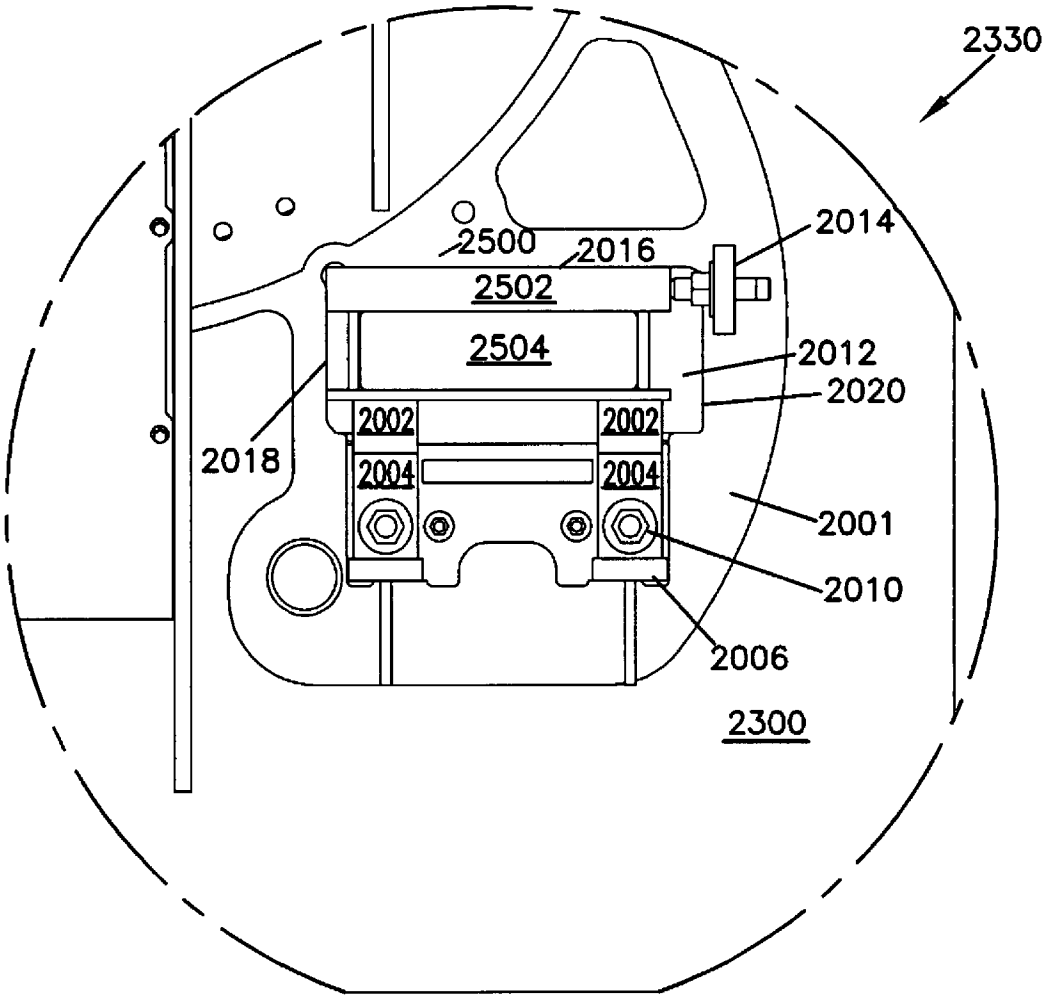
FIG. 11 is a partial right-side view of a second embodiment of a material grinder according to the present disclosure.
Figure 12:
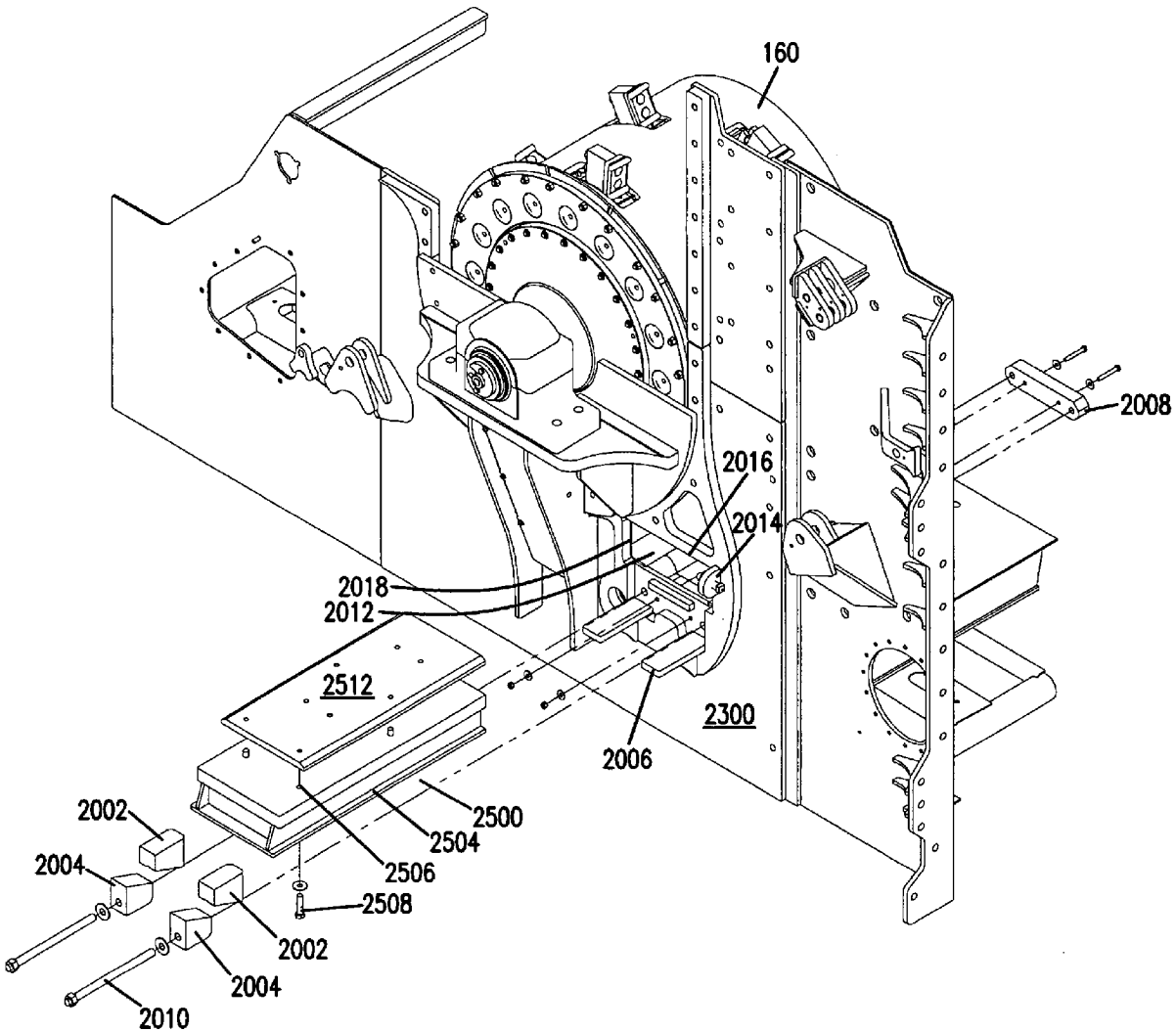
FIG. 12 is a partially exploded perspective view of the right side of the material grinder of FIG. 11, showing an anvil, a mount, and a clamp arm of the present invention.
Figure 13:
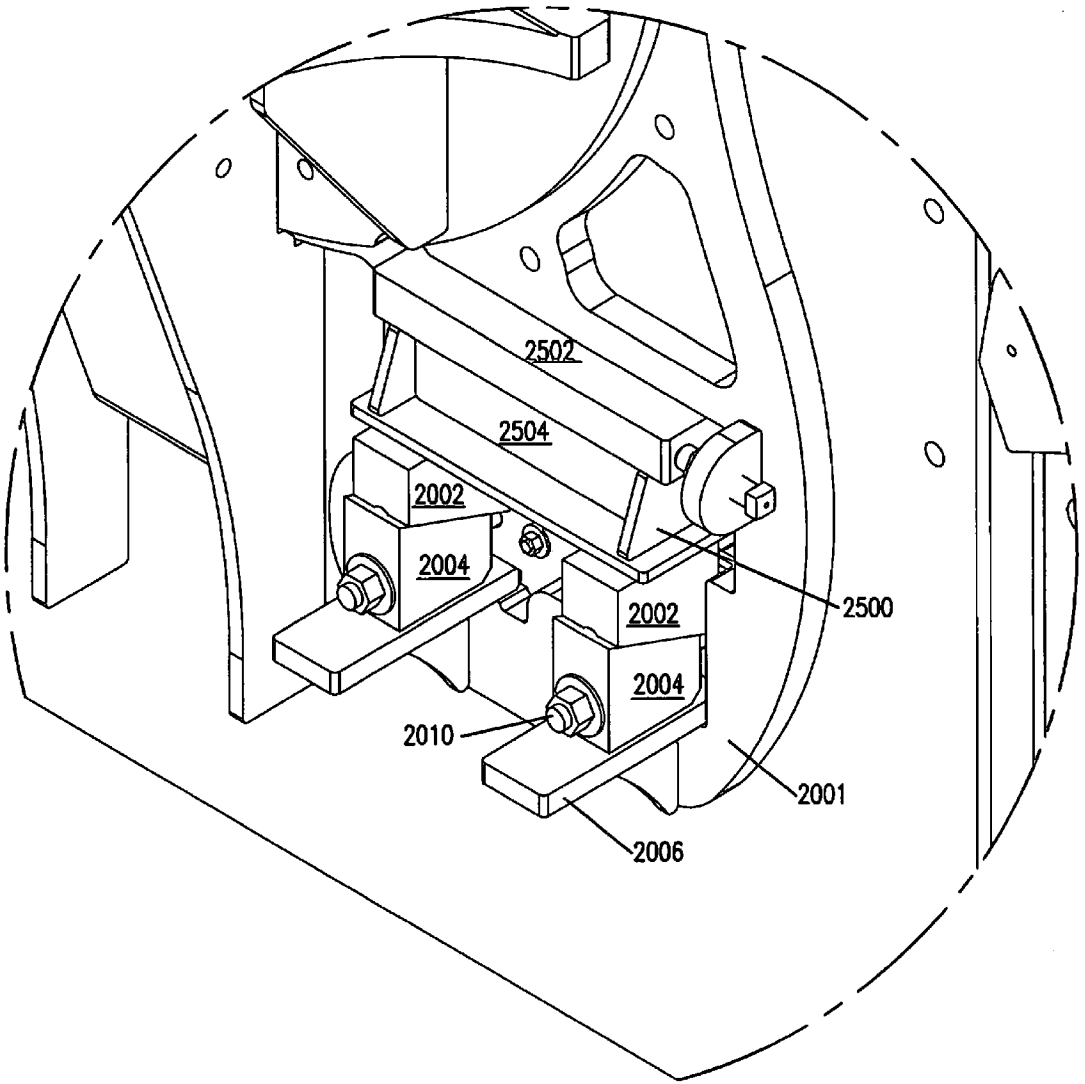
FIG. 13 is a partial perspective view of the right side of the material grinder of FIG. 11, showing the anvil, the mount, and the clamp arm in installed positions.
Figure 14:
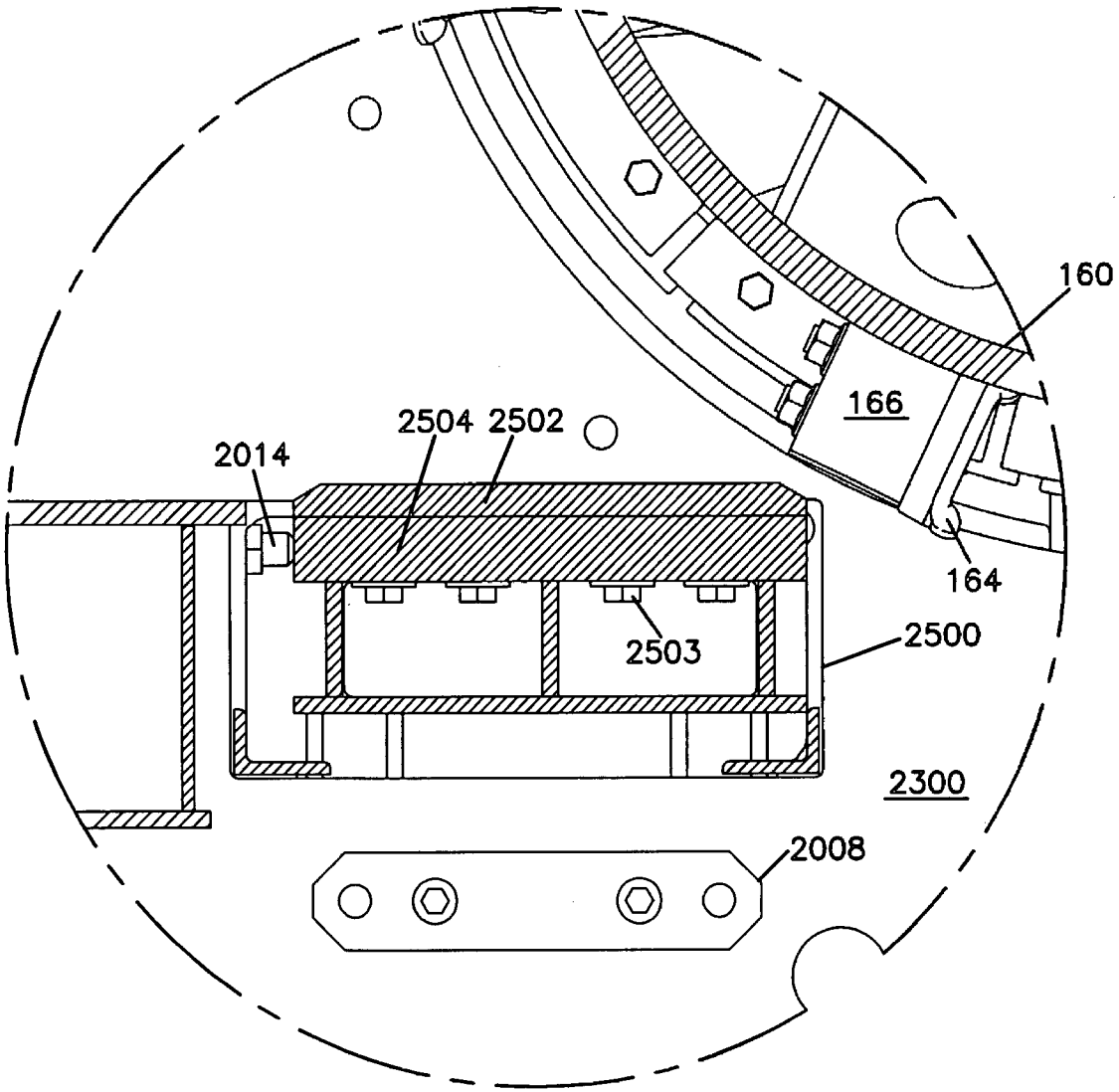
FIG. 14 is a cross-sectional view of a portion of the material grinder of FIG. 11.

Referring now to FIGS. 4-6, the anvil 500 and the mounting arrangement 330 of the grinder 100 are illustrated (the conveyor roller 202 is not shown for purposes of clarity). The mounting arrangement 330 includes adapters 210 positioned on opposite sides of the material grinder 100 such that the anvil 500 is generally parallel to an axis of rotation of the grinding drum 160. Each of the adaptors 210 is mounted to an outside surface of the corresponding mill box side 300 with fasteners 230. The adapter 210 is restrained in a stationary rotational orientation by a stop structure 219 that reacts against the gusset 309. In particular, the gusset 309 includes a reaction surface 310 (FIG. 5). The stop structure 219 of the adaptor 210 is configured to react with the reaction surface 310 of the gusset 309 to transfer a portion of any load applied to the anvil 500 directly to the cross-member 308. Accordingly, the cross-member 308 structurally supports the gusset 309 to maintain the adapter 201 in the stationary rotational orientation.

Still referring to FIGS. 4-6, the adaptor 210 also includes a bearing mount surface 214 and first and second anvil mounting surfaces 216, 218. The adaptors 210 are configured to fit into apertures 302 formed in the sides 300 of the mill box 150. Each of the adaptors 210 includes a flange 220 having holes 212 to receive the fasteners 230 that secure the adaptor to the corresponding mill box side 300. The anvil 500 is structurally configured to provide sufficient rigidity that can withstand grinding forces generated during operation, and to provide adequate protection for, and to cooperate with, the second conveyor roller 202 and conveyor chain 117. As shown in FIG. 3, the first surface 502 of the anvil 500 is essentially a planar extension of the transport plane 111 of the feed table 112 (FIG. 1). The mill box sides 300 are spaced apart by the cross-members 308, 318 (FIG. 3) to define the grinding width of the materials grinder 100. Each of the mill box sides 300 includes an aperture 304 configured to receive the anvil 500. The anvil 500 passes through one mill box side 300 to and through the opposite mill box side 300. The anvil 500 has a length that is greater than the grinding width defined by the mill box sides 300 of the mill box 150. That is, the anvil 500 is longer than the grinding width such that when properly positioned, ends of the anvil 500 extend beyond an outer surface of the mill box sides 300. The ends of the anvil 500 engage with the first and second anvil mounting surfaces 216 and 218 of each of the adaptors 210. Any forces applied to the anvil 500 are transferred to the adaptors 210. The mounting arrangement of the grinder 100 utilizes the adaptors 210 to support and position both the anvil 500 and the second conveyor roller 202. The anvil 500 is supported by the first and second planar anvil mounting surfaces 216 and 218, while being positioned and retained in a direction parallel to the grinding drum axis. The anvil 500 is secured in position by bolts 242 and clips 244 (FIG. 6).

Still referring to FIGS. 4-6, the mounting arrangement 330 also includes clamp arms 400. The anvil 500 is further restrained by the clamp arms 400 having a width sized and configured to provide a secure clamping force on the anvil 500. The clamp arm 400 forces the anvil 500 against the first and second anvil mounting surfaces 216 and 218 such that the anvil 500 can be described as a beam with fixed supports. In order to achieve this type of mounting, the first and second anvil mounting surfaces 216 and 218 are sized to provide sufficient load carrying areas A1, A2 (FIG. 5). The clamp arm 400 includes a first end 402 and a second end 406. A contact structure 404 is located between the first and second ends 402, 406 of the clamp arm 400. The first end 402 of the clamp arm 400 is interconnected to an actuator 410. The actuator 410 includes a bolt 411 and a slug 412. The bolt 411 mounts the first end 402 of the actuator 410 to the first cross-member 308. The second ends 406 of each of the clamp arms 400 are configured to react against frame member 306. Each of the frame members 306 is attached to the sides 300 of the mill box 150. The bolt 411 is secured to the first cross-member 308. As the bolt 411 is tightened, the contact structure 404 of the clamp arm 400 contacts the anvil 500 and pivots the second end 406 of the clamp arm 400 upward. The second end 406 of the clamp arm anchors or reacts against the frame member 306. This creates a clamp force against the anvil 500 at the anvil contact structure 404. The clamp force applied to the anvil 500 by the anvil contact structure 404 is transferred through the adaptor 210 creating a reaction force at the stop structure 219. The reaction force at the stop structure 219 acts against the reaction surface 310 (FIG. 5) of the gusset 309. The gusset 309 thereby transfers some of the clamp force to the cross-member 308 to which the gusset 309 is attached. In addition, some of the clamp force is transferred from the adaptor 210 to the mill box sides 300 through the frame member 306 and the bore 302.

Referring to FIGS. 7-10, a first embodiment of an anvil mounting arrangement 1330 for a grinder according to the present disclosure is described. In the depicted embodiment the adaptor 1210 is configured to engage the clamp arm 1400 and mount the conveyor roller 202 (FIGS. 2 and 3) of a grinder. Since the anvil 1500 is supported by the adaptor 1210, which also supports the conveyor roller 202 that supports the feed table 112, the anvil 1500 is located in a predictable position relative to the feed table 112 (FIG. 1). In other words, the configuration enables the anvil 1500 to be held in a constant and stationary position relative to the feed table 112. The depicted configuration directs loads applied to the anvil 1500 to the cross-members 1308 and to the to the mill box sides 1300. The transfer of force from the anvil 1500 to the adaptor 1210 through the clamp arm 1400 in accordance to the present disclosure is more efficient than the transfer of force in the above-described prior art configuration. The second end 1406 of the clamp arm 1400 is directly engaged with the adaptor 1210 rather than engaged with the frame member 306 and connected to the side of the mill box 300 as shown in the prior art configuration described above (see FIGS. 4 and 5). Also, the first end 1402 is connected directly to the adaptor 1210 rather via the cross-member 308 as shown in the prior art embodiment (see FIGS. 4 and 5). According to the present disclosure, the clamp loads are contained within the clamp arm 1400 and adaptor 1210. In addition to providing a system with better force transfer, the anvil mounting arrangement 1330 of the present disclosure provides a system in which the anvil 1500 can be more easily replaced than in the prior art anvil mounting arrangement 330 described above. The mounting arrangement 1330 according to the present disclosure includes fewer separate parts than the mounting arrangement 330. In the depicted embodiment, first end 1402 of the clamp arm 1400 is connected to the adaptor 1210 via a bolt assembly 1411.

Still referring to FIGS. 7-10, the anvil mounting arrangement 1330 is described in greater detail. In the depicted embodiment the adaptor 1210 includes an upper hooked portion 1212 contoured to engage the second end 1406 of the clamp arm 1400. In the depicted embodiment, the hooked portion 1212 includes a reinforced member 1214 for added structural support. The anvil mounting arrangement further includes an anvil support portion 1216 that is configured to engage and support a portion of the anvil 1500. In the depicted embodiment, the anvil 1500 includes a clip 1506 that engages a side surface of the anvil support portion 1216. In some embodiments the anvil 1500 can be removed and replaced by loosening the clamp member 1400 and disengaging the clip 1506. The adaptor 1210 further includes an arm member 1218 that is configured to engage the cross-member 1308. In the depicted embodiment the arm member 1218 extends along the mill box side 1300 above gussets 1302 and below the cross-member 1308. A bolt assembly 1304 extends through the gusset 1302, the arm member 1218, and the cross-member 1308. The adaptor 1210 is further attached to the sides of the mill box 1300 via bolts 1220 that extend through the adaptor and the sides of the mill box 1300. In the depicted embodiment the clamp arm 1400 includes a portion that contacts the anvil 1500 and presses it towards the adaptor 1210. In the depicted embodiment, the portion contacts the top surface 1502 of the anvil 1500 and a notched out back portion 1504 of the anvil 1500 and forces the anvil 1500 towards the center of the adaptor 1210.

A second embodiment of an anvil arrangement for a grinder according to the present disclosure shown in FIGS. 11-14 is described below. In the depicted embodiment the anvil 2500 is supported on the grinder via an anvil mounting arrangement 2330. The mounting arrangement includes a vertical clamping mechanism 2001 for raising and lowering the anvil 2500. In the depicted embodiment, the vertical clamping mechanism 2001 includes upper wedges 2002 and lower wedges 2004 supported on the side wall 2300 of the mill box. In the depicted embodiment the lower wedges 2004 are supported on protrusions 2006. A bolt assembly 2010 extends through the lower wedges 2004 and engages a backing plate 2008. Tighten the bolt assembly 2010 moves the lower wedges 2004 closer to the side wall 2300 of the mill box. The movement of the lower wedges 2004 towards the side wall 2300 causes the anvil 2500 to move upward. The bolt assembly 2010 can be tightened until the anvil 2500 abuts the top edge 2016 of the aperture 2012. The mounting arrangement 2330 includes a horizontal adjustment mechanism 2014 adjacent the rear edge 2020 of the aperture 2012 that can be used to secure the horizontal position of the anvil 2500. In the depicted embodiment, the horizontal adjustment mechanism is a bolt that can be used to push the anvil 2500 towards the front edge 2018 of the aperture 2012 (i.e., the front edge 2018 of the aperture 2012 is the surface farthest from roller 118 (FIG. 1), which is opposite the rear edge 2020). In the depicted embodiment the anvil 2500 can be removed and replaced by releasing the bolt assembly 2010 and the horizontal adjustment mechanism 2014. In the depicted embodiment the anvil 2500 includes a top contact surface 2502 and a bottom support member 2504. The contact surface 2502 can be connected to the bottom support surface via apertures 2506 and bolts 2508. Alternatively, the contact surface 2502 can be integral with the support member 2504 or attached to the support member 2504 by other means (e.g., welded to the support member 2504). In the depicted embodiment the bottom end surface of the support member 2504 is flat rather than angled. The bottom end surface of the support member 2504 engages the upper wedges 2002, which are configured to slide against the lower wedges 2004 when the bolt assembly 2010 is loosened or tightened. It should be appreciated that in alternative embodiments, the bottom end surface of the support member 2504 could be angled and configured to directly engage the bottom wedge 2004, thereby eliminating the upper wedges 2002.

Various principles of the embodiments of the present disclosure may be used in applications other than the illustrated down-cut horizontal grinders. For example, the principals of the present disclosure may likewise be adapted to a tub grinder or to an up-cut horizontal grinder. The above specification provides a complete description of the present invention. Since many embodiments of the invention can be made without departing from the spirit and scope of the invention, certain aspects of the invention reside in the claims hereinafter appended.

We claim:

1. A grinding machine, comprising:

a mill box;

a grinding drum positioned within the mill box;

a feed table for transporting material to the mill box, the feed table defining a transport plane;

an adaptor connected to the mill box, the adaptor being configured to support an end of the feed table;

an anvil having a contact surface and opposed ends, the anvil being oriented such that the anvil contact surface is positioned between the grinding drum and the feed table and the opposed ends of the anvil extend beyond the sides of the mill box; and a clamp arm including a first end and a second end, wherein the first end engages a first portion of the adaptor and the second end is connected to a second portion of the adaptor, wherein the first portion of the adaptor extends over the anvil, and wherein at least one of the opposed ends of the anvil is clamped between the clamp arm and the adaptor.

2. The machine of claim 1, wherein the first portion of the adaptor is hook shaped and contacts the first end of the clamp arm.

3. The machine of claim 2, further comprising a bolt assembly that connects the second end of the clamp arm to the second portion of the adaptor.

4. The machine of claim 3, wherein the second portion of the adaptor is bolted to a cross member that extends across the mill box.

5. The machine of claim 4, wherein the cross-member is positioned below and between the first and second ends of the clamp arm in a horizontal direction, and between the second portion of the adaptor and the clamp arm in the vertical direction.

6. The machine of claim 2, wherein the first portion includes a replicable reinforcement member.

7. The machine of claim 4, wherein the second portion extends between the cross-member and a gusset on the side of the mill box.

8. The machine of claim 1, wherein the clamp member contacts a first surface and a second surface on the anvil, wherein the first and second surfaces are inclined relative to each other.

9. The machine of claim 8, wherein the contact forces applied by the clamp arm to the first surface of the anvil are primarily vertical and the contact forces applied by the clamp arm to the second surface are primarily horizontal.

10. A grinding machine, comprising:

a mill box having opposite sides, the opposite sides of the mill box defining a grinding width, each of the sides defining an aperture;

a grinding drum positioned within the mill box;

an anvil located adjacent to the grinding drum, the anvil having a length greater than the grinding width of the mill box such that the ends of the anvil extend beyond the sides of the mill box through the apertures in the sides of the mill box; and a clamp mechanism configured to engage the ends of the anvil, the clamp mechanism including:

i) a wedge that is configured to slide towards the sides of the mill box to press the anvil against a top edge of the aperture; and ii) a horizontal anvil securing member that is configured to press the anvil against a side edge of the aperture.

11. The machine of claim 10, wherein the wedge includes an aperture therein that is configured to receive a bolt.

12. The machine of claim 11, wherein the wedge is positioned below the anvil and is configured to slide towards the side of the mill box when the bolt that extends through the aperture in the wedge is rotated.

13. The machine of claim 10, wherein the clamp mechanism includes a pair of lower wedges and a pair of upper wedges, the upper wedges configured to contact the bottom surface of the anvil and the lower wedges configured to slidably contact the upper wedges.

14. The machine of claim 10, wherein the anvil includes a contact surface and a support member connected below the contact surface.

15. The machine of claim 14, wherein the contact surface of the anvil is bolted to the support member of the anvil.

16. The machine of claim 10, wherein the clamp mechanism further comprises a support plate attached to the side surface of the mill box configured to provide auxiliary support for the side and top edges of the aperture.

17. A grinding machine, comprising:

a mill box;

a grinding drum positioned within the mill box;

a feed table for transporting material to the mill box, the feed table defining a transport plane;

an adaptor connected to the mill box, the adaptor being configured to support an end of the feed table;

an anvil having a contact surface and opposed ends, the anvil being oriented such that the anvil contact surface is positioned between the grinding drum and the feed table and the opposed ends of the anvil extend beyond the sides of the mill box; and a clamp arm including a first end and a second end, wherein the first end engages a hook-shaped first portion of the adaptor and the second end is connected to a second portion of the adaptor by a bolt assembly, and wherein the second portion of the adaptor is bolted to a cross member that extends across the mill box;

wherein at least one of the opposed ends of the anvil is clamped between the clamp arm and the adaptor.

18. The machine of claim 17, wherein the cross-member is positioned below and between the first and second ends of the clamp arm in a horizontal direction, and between the second portion of the adaptor and the clamp arm in the vertical direction.

19. A grinding machine, comprising:

a mill box;

a grinding drum positioned within the mill box;

a feed table for transporting material to the mill box, the feed table defining a transport plane;

an adaptor connected to the mill box, the adaptor being configured to support an end of the feed table;

an anvil having a contact surface and opposed ends, the anvil being oriented such that the anvil contact surface is positioned between the grinding drum and the feed table and the opposed ends of the anvil extend beyond the sides of the mill box; and a clamp arm including a first end and a second end, wherein the first end engages a hook-shaped first portion of the adaptor and the second end is connected to a second portion of the adaptor by a bolt assembly;

wherein at least one of the opposed ends of the anvil is clamped between the clamp arm and the adaptor;

wherein a cross-member extends across the mill box, the cross-member being positioned below and between the first and second ends of the clamp arm in a horizontal direction, and between the second portion of the adaptor and the clamp arm in the vertical direction.

20. A grinding machine, comprising:

a mill box;

a grinding drum positioned within the mill box;

a feed table for transporting material to the mill box, the feed table defining a transport plane;

an adaptor connected to the mill box, the adaptor being configured to support an end of the feed table;

an anvil having a contact surface and opposed ends, the anvil being oriented such that the anvil contact surface is positioned between the grinding drum and the feed table and the opposed ends of the anvil extend beyond sides of the mill box; and a clamp arm including a first end and a second end, wherein the first end engages a first portion of the adaptor and the second end is connected to a second portion of the adaptor, wherein the second portion of the adapter extends between a cross-member that extends across the mill box and a gusset provided on one side of the mill box, wherein at least one of the opposed ends of the anvil is clamped between the clamp arm and the adaptor.

* * * * *